US005297703A

United States Patent [19]

Tsao et al.

[11] Patent Number: 5,297,703

[45] Date of Patent: Mar. 29, 1994

[54] NON-SPILL LOADING DEVICE FOR THE LOADING OF BOTTLED FLUID INTO A DISPENSER

[76] Inventors: Chein-Hwa Tsao; Emily M. Tsao, both of 19601 Ladera Ct., Saratoga, Calif. 95070

[21] Appl. No.: 30,695

[22] Filed: Mar. 12, 1993

Related U.S. Application Data

[63] Continuation-in-part of Ser. No. 834,800, Feb. 13, 1992, abandoned.

[51] Int. Cl.[5] ..... B67D 3/02

[52] U.S. Cl. ..... 222/507; 222/509; 141/21; 141/321; 141/351; 141/352; 141/364

[58] Field of Search ..... 222/505, 507, 509, 513, 222/514, 518, 559; 141/351-353, 356, 363, 364, 368, 21, 319, 321

[56] References Cited

U.S. PATENT DOCUMENTS

| | | | |
|---|---|---|---|
| 1,246,879 | 11/1917 | Chadwick | 141/352 X |
| 1,248,705 | 12/1917 | Pogue . | |
| 1,538,483 | 1/1925 | Grantham | 141/364 X |
| 1,903,139 | 3/1933 | Trompeter | 141/352 X |
| 2,495,015 | 1/1950 | McGrath | 222/507 |
| 3,074,444 | 1/1963 | Hawksford | 141/353 |
| 3,698,603 | 10/1972 | Radcliffe | 222/146.6 |
| 4,508,246 | 4/1985 | Grenn | 141/364 X |
| 4,664,349 | 5/1987 | Johansen et al. | 248/156 |
| 4,676,775 | 6/1987 | Zolnierczyk et al. | 604/28 |
| 4,717,051 | 1/1988 | Leclerc | 141/364 X |
| 4,972,976 | 11/1990 | Remero | 141/353 X |

FOREIGN PATENT DOCUMENTS

| | | | |
|---|---|---|---|
| 0155098 | 8/1952 | Australia | 141/351 |

OTHER PUBLICATIONS

Water Tech Industries Spill-Free TM Oct. 14, 1992.
Elkay Blakhawk, Oct. 1992.

*Primary Examiner*—Andres Kashnikow
*Assistant Examiner*—Kenneth Bomberg
*Attorney, Agent, or Firm*—James J. Leary

[57] ABSTRACT

A device for the loading of bottled fluid with no spillage consists of a valve body and a base plate coupled to the valve body in a vertically slidable manner. The valve body consists of a body, an integrated cap handle, a bottle seal and a pair of hinge brackets. The base plate consists of a body, a set of bottle stabilization posts and a pair of hinge brackets which, being coupled to the valve body through a pair of clamp levers, converts the sliding movements between the base plate and the valve body into rotations of the clamp levers to permit or prohibit the flow of fluid from the bottle regardless of its orientation while simultaneously unlocking or locking the device onto the bottle.

10 Claims, 5 Drawing Sheets

NON-SPILL LOADING DEVICE FOR THE LOADING OF BOTTLED FLUID INTO A DISPENSER

This patent application is a continuation in part of U.S. patent application Ser. No. 07/834,800 filed on Feb. 13, 1992, now abandoned.

FIELD OF THE INVENTION

The present invention relates to the loading and removal of a bottled fluid into and from its operating position which is inverted and sits on top of a corresponding fluid dispenser. More particularly, it relates to a device with a linear valve to prevent fluid from spilling from a container when it is inverted for loading onto a fluid dispenser.

BACKGROUND OF THE INVENTION

Many offices, stores, factories and homes are equipped with drinking water dispensers for their members. While some dispensers are plumbed permanently to a tap water supply, other employ a user replaceable supply, such as an inverted water bottle removably mounted on top of the dispenser. Examples of the design of such dispensers are U.S. Pat. No. 3,698,603 issued Oct. 1972 to Radcliffe and U.S. Pat. No. 4,664,349 issued May 1987 to Johansen.

One of the primary difficulties with such prior art dispenser systems employing an inverted bottle lies in the procedure of user replacement of a used bottle. At this time, a nearby full bottle has to be substituted in its place. Typically the bottles are of 5 gallon capacity and therefore very heavy. This means that, after the user removes the used bottle and opens the cap of the full bottle, the user would have to lift the full bottle and, in one very quick movement, invert it and insert its neck accurately into the intake opening on top of the dispenser and maneuver the body of the bottle into vertical position for normal operation. Any less than good execution of this exceptionally demanding procedure will result in excessive water spillage plus possible personal injury. In any case, the current procedure always wastes some water through unavoidable spillage, in addition to being dangerous to the user.

Two prior patents taught the idea of, upon loading of the full container, piercing an otherwise sealing member of the container thus establishing either the flow of one single fluid or the simultaneous flow of two different fluids from the supply bottle. The piercing element being a permanent part of the dispenser. These are U.S. Pat. No. 1,248,704 issued Oct. 1916 to Pogue and U.S. Pat. No. 4,676,775 issued June 1987 to Zolnierczyk, et al. But the implementation of these methods would require the modification of the existing dispensers and bottles which is undesirable. One earlier patent application (Emily M. Tsao, filed February 1992, patent pending) taught the idea of, upon loading of the full container, opening up a ball valve under the weight of the full container through a linear to rotational movement conversion mechanism. Although this invention does achieve the objective of nonspill loading without any modification of the existing dispensers and bottles, a different, simpler design concept was conceived later to achieve the same functionality.

SUMMARY AND OBJECTIVES OF THE CURRENT INVENTION

A principal objective of the invention is to provide a user friendly device which realizes a much less stressful procedure of loading a full bottle of fluid onto a dispenser while assuring spill free results every time.

Another objective of the invention is to achieve the principal objective without having to change any of the existing system components, be it the bottle or the dispenser.

A third objective of the invention is to achieve the principal objective with a single seal member while minimizing the chance of user contamination of any fluid contacting or splashing part of the device during application.

Accordingly, this invention provides a non-spill device for the loading of bottled fluid into a dispenser. This device has a valve body, two clamp levers and a base plate as its major functional subsystems. The valve body consists of a bottle seal, a cap handle plus two valve body hinge brackets to allow easy removal and attachment of the device onto the full bottle for leakage free inversion of the bottle by the user later. The base plate, having a set of bottle stabilization posts thereon, acts as a positive stop and a stable seating means for the bottle upon its loading. The two clamp levers, being rotatably attached to both the valve body and the base plate through a set of axial pins, accomplish the function of locking and unlocking of the bottle seal against the bottle opening before and during the process of bottle loading. Thus, the flow of fluid from the bottle upon inversion is either prohibited or permitted as desired.

DETAILED DESCRIPTION OF PREFERRED EMBODIMENT

Figure 1A:
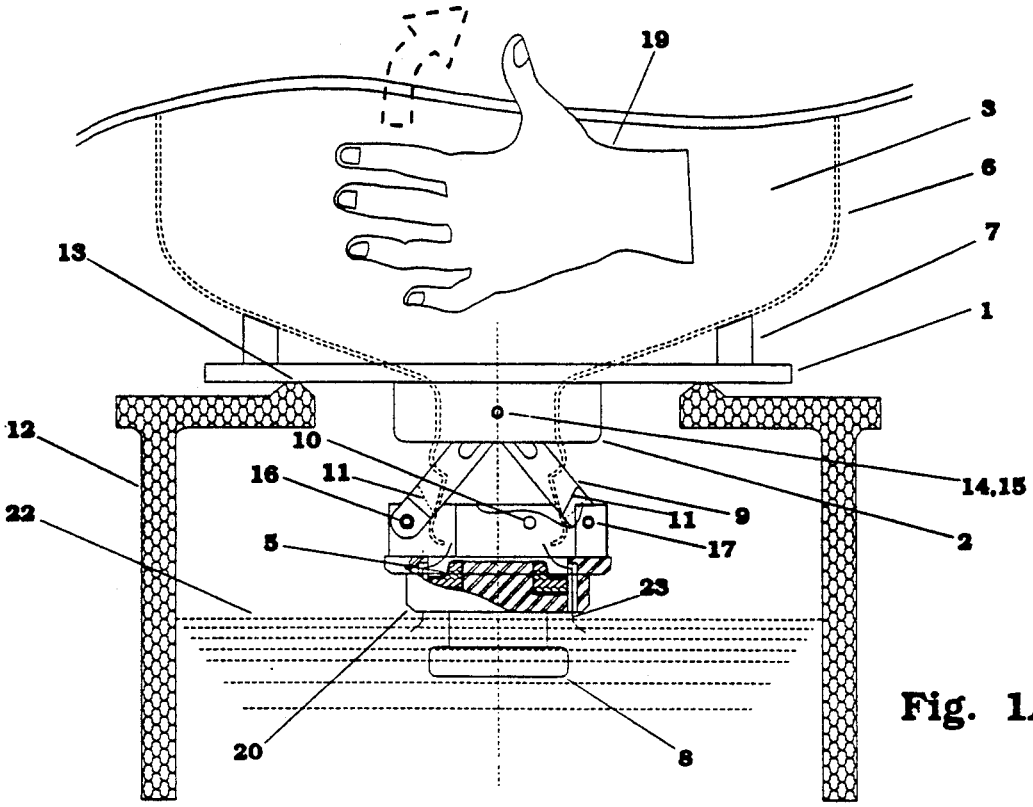
FIGS. 1A and 1B are the views of the device together with an empty bottle still in their normal operating position but ready to be removed from the dispenser by the user.
Figure 1B:
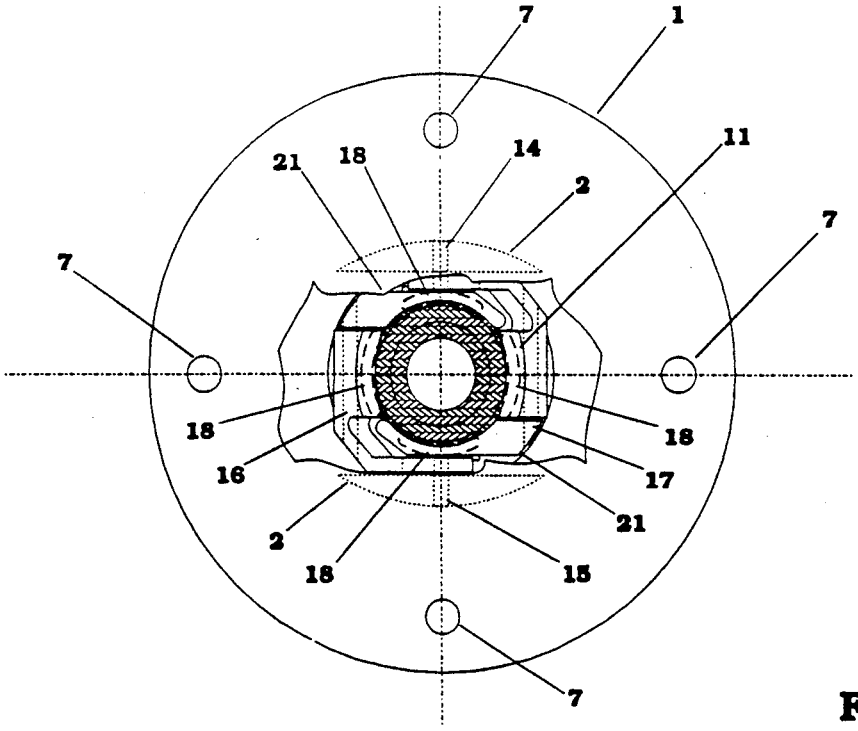

Referring now to FIGS. 1A and 1B. The non-spill loading device consists of a substantially cylindrical valve body 20 with four vertical feed slots 18 peripherally located within its body for fluid flow from the bottle 3 to the internal reservoir of the dispenser body 12. The corresponding flow path is illustrated as 23. Seated inside the valve body 20 is an approximately ring-shaped bottle seal 5 with an appropriate cross section such that it will provide a fluid tight seal against the bottle opening when they are later pressed together. The material for the bottle seal 5 can be any of the many elastomeric varieties appropriate to the product application. On top of the valve body 20 are two valve body hinge brackets 21 each with one hole bored through in the horizontal plane for rotational coupling with other members of the valve via axial pins. In addition, the valve body 20 has an integrated cylindrical cap handle 8 whose function will become clear later.

Rotatably coupled to the valve body hinge brackets 21, through two axial pins 16 and 17, are two clamp levers 9. At the other end of the clamp levers 9 are elongated slots for both rotatably and slidably coupling to other members of the valve. As shown, the valve is in its open position with the clamp lever locking jaws 11 resting against the neck area of the bottle surface 6.

In its operating position, the disk-shaped base plate 1 rests firmly on top of the dispenser top rim 13. On top of the base plate 1 are a set of four integrated bottle stabilization posts 7 whose top surfaces are profiled to closely match the bottle surface 6. Thus, the bottle 3 is stabilized in its operating position. The underside of the base plate 1 has two integrated base plate hinge brackets 2 each with one hole bored through in the horizontal plane for rotatably and slidably coupling to the aforementioned clamp levers 9 via axial pins 14 and 15. Finally, the existing conventional dispenser body is illustrated as 12 with its contained water 22.

OPERATION

The first step of the non-spill loading device operation is again illustrated in FIGS. 1A and 1B where the water in the bottle 3 has just been consumed completely by the dispenser body 12. The linear valve has been in its fully open position with the top of the bottle seal 5 below the bottle opening allowing unimpeded peripheral flow of fluid out of the bottle along the illustrated path 23. The bottom surface of the base plate 1 forms an annular seal with the dispenser top rim 13 against environmental dust and excessive evaporation of the water inside the dispenser body 12. Additionally, the bottle stabilization posts 7, either in close proximity or contact with the bottle surface 6, help to insure the lateral stability of the bottle 3 when it used to be full of water. With his hands 19, the user now removes the empty bottle 3 together with the non-spill loading device. The corresponding movement is indicated by the dashed arrow.

Figure 2:
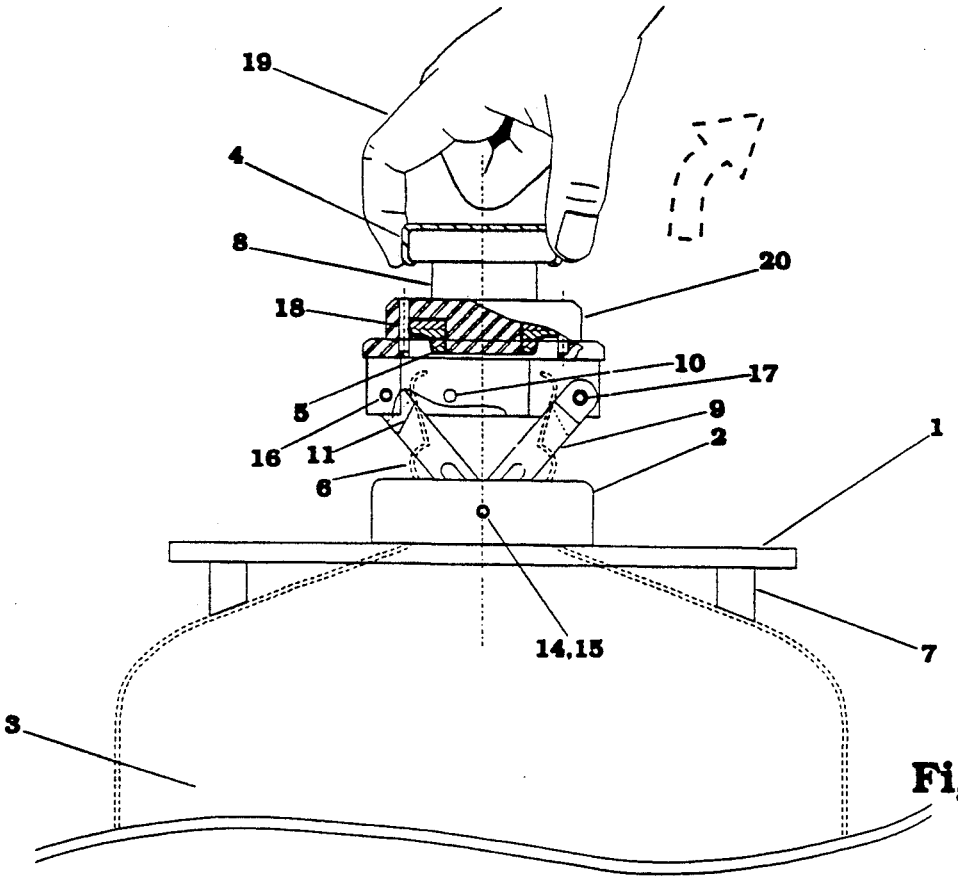
FIG. 2 is the view after the user has removed the empty bottle from the dispenser, capped the device for santiary handling but has yet to remove the device from the empty bottle.

FIG. 2 depicts the situation after the user has set down the empty bottle 3 to its upright position together with the non-spill loading device. The user now follows the normal procedure to open up a full bottle (not shown). However, instead of discarding the bottle cap, the user now presses the bottle cap 4 firmly onto the cap handle 8 forming a temporary interference fit. Notice that the non-spill loading device, being in its open position, fits only loosely over the bottle 3. Therefore, the non-spill loading device is easily lifted off the bottle 3 by the user hands 19 via the bottle cap 4, as illustrated by the dashed arrow. Thus, user contamination of the wetted portion of the device is avoided here.

Figure 3:
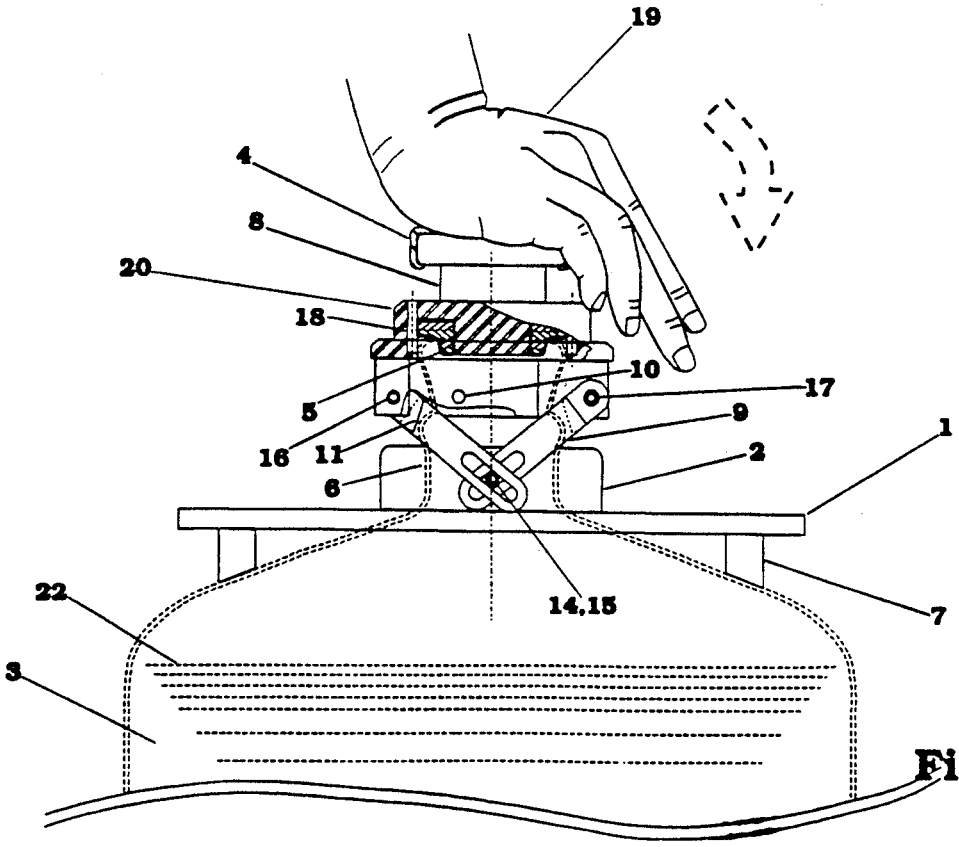
FIGS. 3 is the view after the user has set and pressed the device on top of a full bottle but has yet to lock the device to the bottle.

The situation after the user has set down the non-spill loading device onto a full bottle is depicted in FIG. 3. By pressing gently through the bottle cap 4 with the hand 19, the bottom portion of the bottle seal 5 is now maneuvered to fit snuggly inside the bottle opening. Notice that the non-spill loading device is still loosely fitting over the full bottle with the clamp lever locking jaws 11 resting on the bottle surface 6.

Figure 4A:
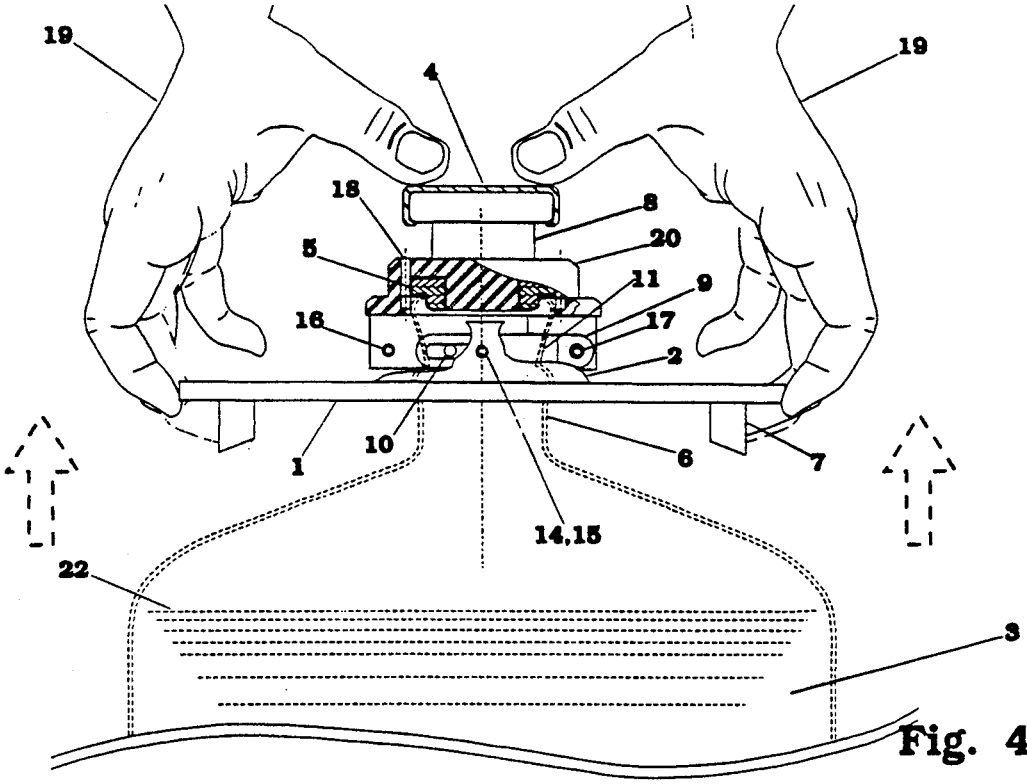
FIGS. 4*a* and 4*b* are the views after the user has squeezed the base plate upwards with respect to the cap handle thus closing the valve but has yet to discard the sanitary cap and load the full bottle onto the top of the dispenser.
Figure 4B:
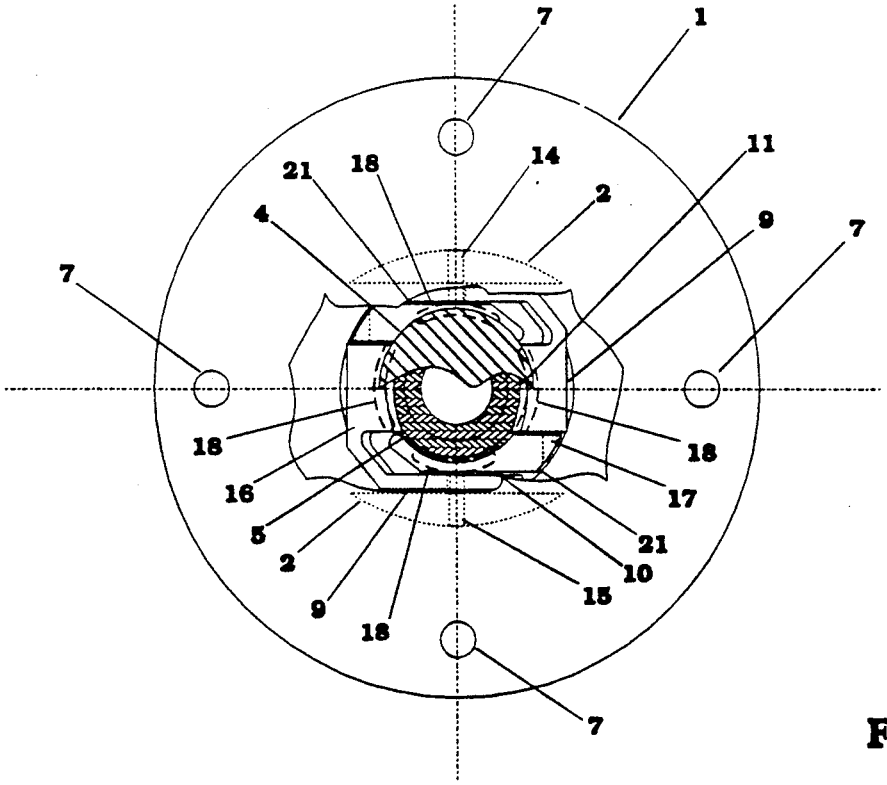

Next, the user proceeds to lock the non-spill loading device onto the bottle and close the valve. This is illustrated in FIGS. 4A and 4B. This is done by squeezing together the valve body 20 and the base plate 1 with the hands 19, causing a corresponding rotation of the clamp levers 9 around the axial pins 16 and 17 while the other axial pins 14 and 15 slide across the elongated slots of the clamp levers 9. Meanwhile, the cam-like movement between the clamp lever locking jaws 11 and the bottle surface 6 causes a downward movement of the valve body 20 toward the bottle opening resulting in a fluid tight, peripheral seal between the bottle seal 5 and the bottle opening. Notice also that the clamp levers 9 have been rotated to such an extent that their elongated slots have forcibly crossed the clamp lever locking bumps 10 forming two stable locking detentes. The net result is a non-spill loading device locked onto the bottle 3 with a fluid tight seal formed therein. User contamination of the wetted portion of the device is also avoided here since the contact is either through the intermediate bottle cap 4 (by the thumbs) or is on the external, dry side of the base plate 1 (by four other fingers). Afterwards, the user pries off and discards the temporary bottle cap 4 (not shown).

Figure 5:
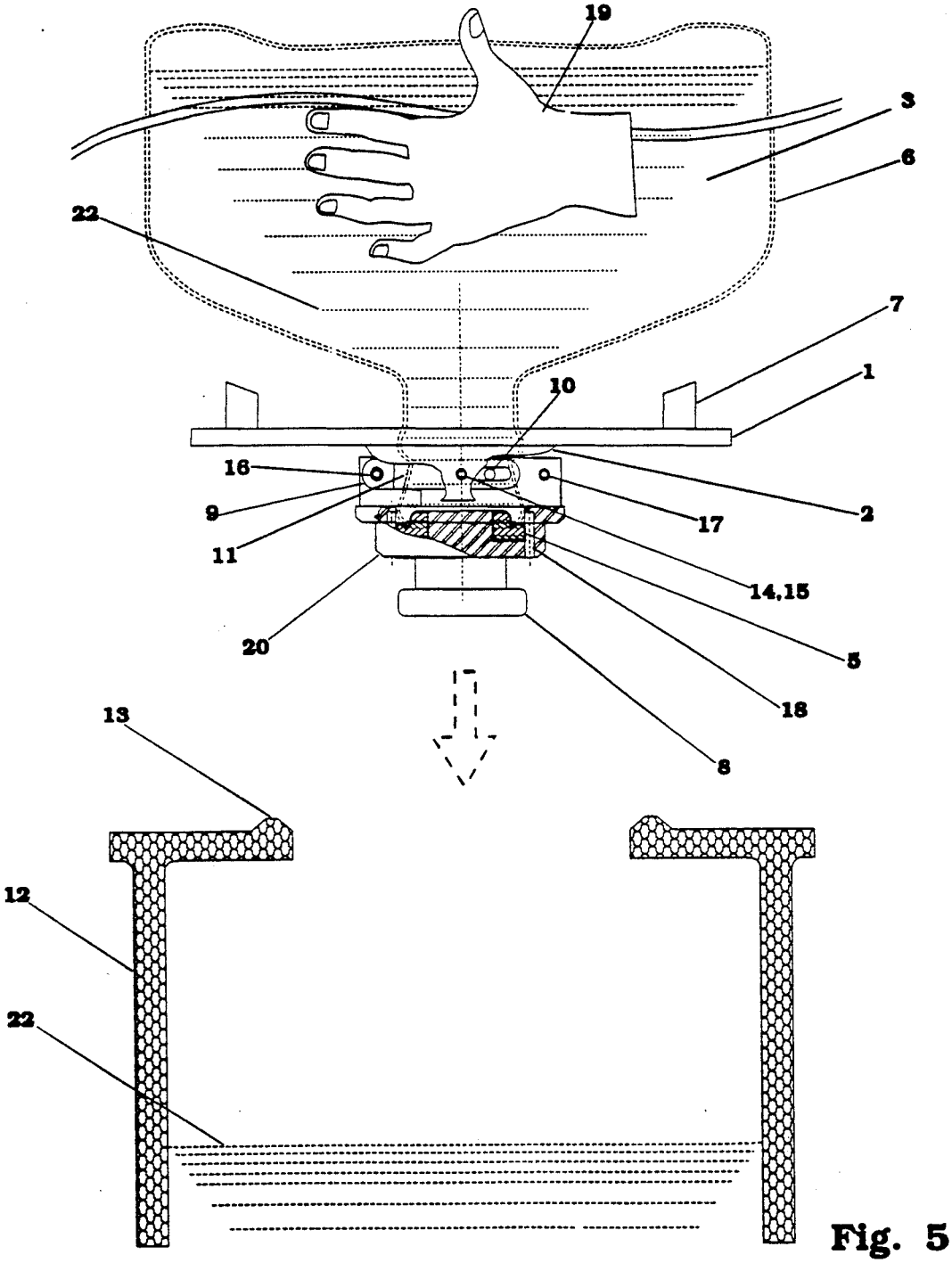
FIG. 5 is the view after the user has discarded the sanitary cap and while the user is loading the full bottle on top of the dispenser.

After inversion, the loading of the full bottle onto the dispenser is illustrated in FIG. 5 by the hand 19 and the dashed arrow. Here, non-spill loading is seen accomplished through the combination of a locked non-spill loading device and a fluid tight seal. Therefore, the present invention has eliminated the prior needs of having the user quickly invert the bottle 3, quickly insert its neck accurately into the dispenser top rim 13 and maneuver the body of the bottle into vertical position for normal operation.

Figure 6A:
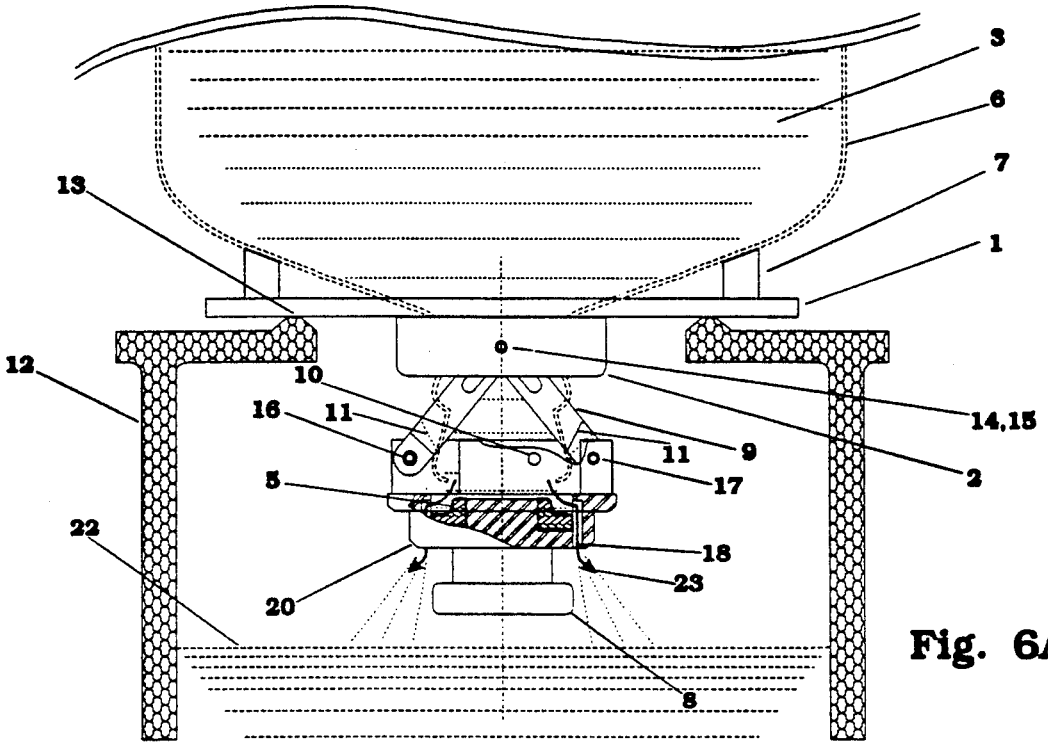
FIGS. 6A and 6B are the views after the user has completed the loading of the full bottle on top of the dispenser with the valve now opened up.
Figure 6B:
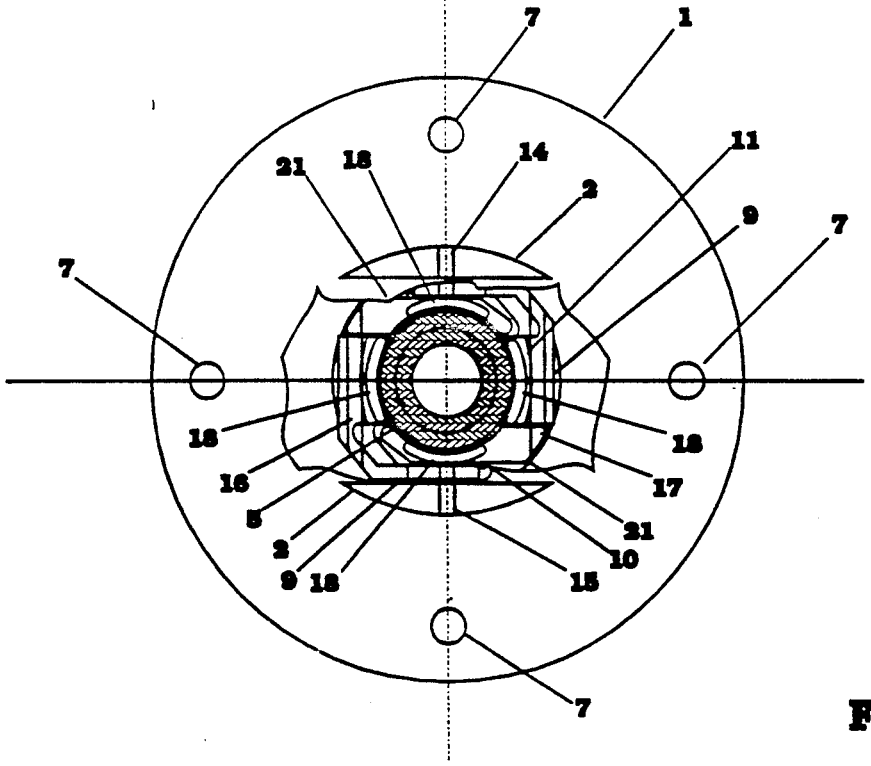

The situation after the user has finished loading the system of non-spill loading device and the full bottle 3 into its inverted operating position on top of the dispenser body 12 is illustrated in FIG. 6. Notice that the base plate 1 is now slidden to its extreme position away from the valve body 20, being stopped by the contact between the bottle stabilization posts 7 and the bottle surface 6, causing the bottle seal 5 to open up again through the corresponding rotation of the clamp levers 9. This is because, under the weight of the descending system of the inverted full bottle 3 and the non-spill loading device, the base plate 1 is forced to slide vertically away from the valve body 20 as soon as the bottom surface of the base plate hits the dispenser top rim 13. The sliding movement of the base plate 1 is in turn translated into forced rotation, out of their respective detente positions defined by the clamp lever locking bumps 10, of the clamp levers 9 through the combined action of the axial pins 14, 15, 16 and 17. With the bottle seal 5 opened up, the full bottle 3 can now resume its normal function of replenishing the dispenser on a continuous basis through the flow paths 23.

CONCLUSION, RAMIFICATIONS AND SCOPE

While a single embodiment of the invention has been described and illustrated in detail, it should be understood that many modifications in the details of design and construction are possible without departing from the spirit of the invention or the scope of the claims. For instance, in alternate embodiments a different type of valve may be used in place of the linear valve that has been described. Likewise, many alternate embodiments are possible for the valve operating mechanism. The valve may be operated manually as with a lever or knob which opens and closes the valve, or different mechanisms other than the clamp levers described may be used to convert the sliding motion of the base plate into sliding motion of the seal in the opposite direction. For example, cams, gears or drive belts. A useful variation of the invention that could be achieved with only minor alterations would be to make the device such that the valve is biased toward the closed position so that it will close automatically when the fluid container is removed from the dispenser. Many different geometries might be used for the valve body or the base plate. For example, the base plate may be made round, rectangular, triangular or conical or it may be made with a number of radially projecting spokes. Attachment means other than the clamp levers described may be used to attach the device to the fluid container. Other types of clamps, springs, set screws or threaded attachments are just some of the possibilities. Alternatively, the entire device, or part of it, might be made integral with the fluid container or the dispenser. These and other variations may be made to the invention while allowing it to carry out its objectives as set forth above.

Thus, the scope of the invention should be determined from the appended claims and their legal equivalents rather than from the examples given.

I claim:

1. A device to prevent spilling fluid while loading a fluid filled container onto a fluid dispenser, said container having a body portion and a neck portion with an opening for fluid to pass through, said device comprising:

a body member having an opening of sufficient diameter to allow passage of said neck portion of said container, a valve member having a sealing means for sealing said opening in said neck of said container, and a pair of clamp levers each having two ends, the first end of said clamp levers being rotatably attached to said valve member, the second end of said clamp levers being rotatably and slidably attached to said body member, said clamp levers each having a locking jaw proximate said first end, said device having two positions, a first position in which said body member is adjacent to said valve member and said clamp levers are rotated toward said body member and said locking jaws engage said neck portion of said container, thereby holding said sealing means in sealing engagement with said opening in said neck of said container, and a second position in which said body member is spaced apart from said valve member and said clamp levers are rotated away from said body member, thereby holding said sealing means apart from said opening in said neck of said container and allowing fluid to flow from said container.

2. The device of claim 1 wherein said valve member further comprises an integral cap handle means for attaching a removable cap to said device.

3. The device of claim 1 wherein said valve member further comprises at least one flow passage through said valve member to allow fluid to flow through said valve member when said device is in said second position.

4. The device of claim 1 further comprising a detent means for holding said device in said first position until a force exceeding a predetermined threshold force urges said body member apart from said valve member.

5. The device of claim 1 further comprising a base plate attached to said body member, said base plate supporting said device and said container in an inverted position on said fluid dispenser.

6. The device of claim 5 wherein said base plate further comprises a stabilization means for supporting said body portion of said container in an inverted position.

7. The device of claim 5 wherein when said fluid filled container is inverted and supported by said base plate, the weight of said fluid filled container forces said device from said first position to said second position.

8. The device of claim 5 further comprising a detent means for holding said device in said first position until a force exceeding a predetermined threshold force urges said device from said first position to said second position.

9. The device of claim 1 wherein, when said device is in said second position, said locking jaws disengage from said neck portion of said container.

10. The device of claim 1 wherein each of said clamp levers has an elongated slot proximate said second end and said clamp levers are rotatably and slidably attached to said body member by means of a pair pivot pins attached to said body member, said pivot pins rotatably and slidably engaging said slots.

* * * * *